US007775033B2

(12) United States Patent
Colignon

(10) Patent No.: US 7,775,033 B2
(45) Date of Patent: Aug. 17, 2010

(54) SYSTEM FOR EVALUATING REGENERATION OF POLLUTION MANAGEMENT MEANS INTEGRATED IN A MOTOR VEHICLE ENGINE EXHAUST LINE

(75) Inventor: Christophe Colignon, Levallois Perret (FR)

(73) Assignee: Peugeot Citroen Automobiles SA, Velizy Villacoublay (FR)

( * ) Notice: Subject to any disclaimer, the term of this patent is extended or adjusted under 35 U.S.C. 154(b) by 868 days.

(21) Appl. No.: 11/571,255

(22) PCT Filed: Jun. 20, 2005

(86) PCT No.: PCT/FR2005/050465

§ 371 (c)(1),
(2), (4) Date: Dec. 22, 2006

(87) PCT Pub. No.: WO2006/005868

PCT Pub. Date: Jan. 19, 2006

(65) Prior Publication Data

US 2008/0059040 A1 Mar. 6, 2008

(30) Foreign Application Priority Data

Jun. 23, 2004 (FR) ..... 04 06859

(51) Int. Cl.
*F01N 3/00* (2006.01)

(52) U.S. Cl. ..... 60/277; 60/273; 60/285; 60/287

(58) Field of Classification Search ..... 60/273–274, 60/285–287, 295
See application file for complete search history.

(56) References Cited

U.S. PATENT DOCUMENTS 5,626,014 A * 5/1997 Hepburn et al. ..... 60/274
6,145,302 A * 11/2000 Zhang et al. ..... 60/274

(Continued)

FOREIGN PATENT DOCUMENTS

DE 19753842 A1 * 6/1999

(Continued)

OTHER PUBLICATIONS

W.R. Salzman, Heat and Heat Capacity : Arizona.edu, Jul. 8, 2004, http://web.archive.org/web/20040807224935/www.chem.arizona.edu/~salzmanr/480a/480ants/heat/heat.html.*

(Continued)

*Primary Examiner*—Thomas E Denion
*Assistant Examiner*—Jesse Bogue
(74) *Attorney, Agent, or Firm*—Nicolas E. Seckel

(57) ABSTRACT

The invention concerns a system for evaluation regeneration of pollution management means (1) integrated in an exhaust line (2) of a motor vehicle engine, characterized in that it comprises means (4) for determining the thermal power input by the exhaust gas upstream of the pollution management means during the regeneration phase thereof and means (4) for comparing said power to threshold values (Sb, Sh) to determine a partial or total failure of regenerating said means.

8 Claims, 2 Drawing Sheets

U.S. PATENT DOCUMENTS

Figure 1:
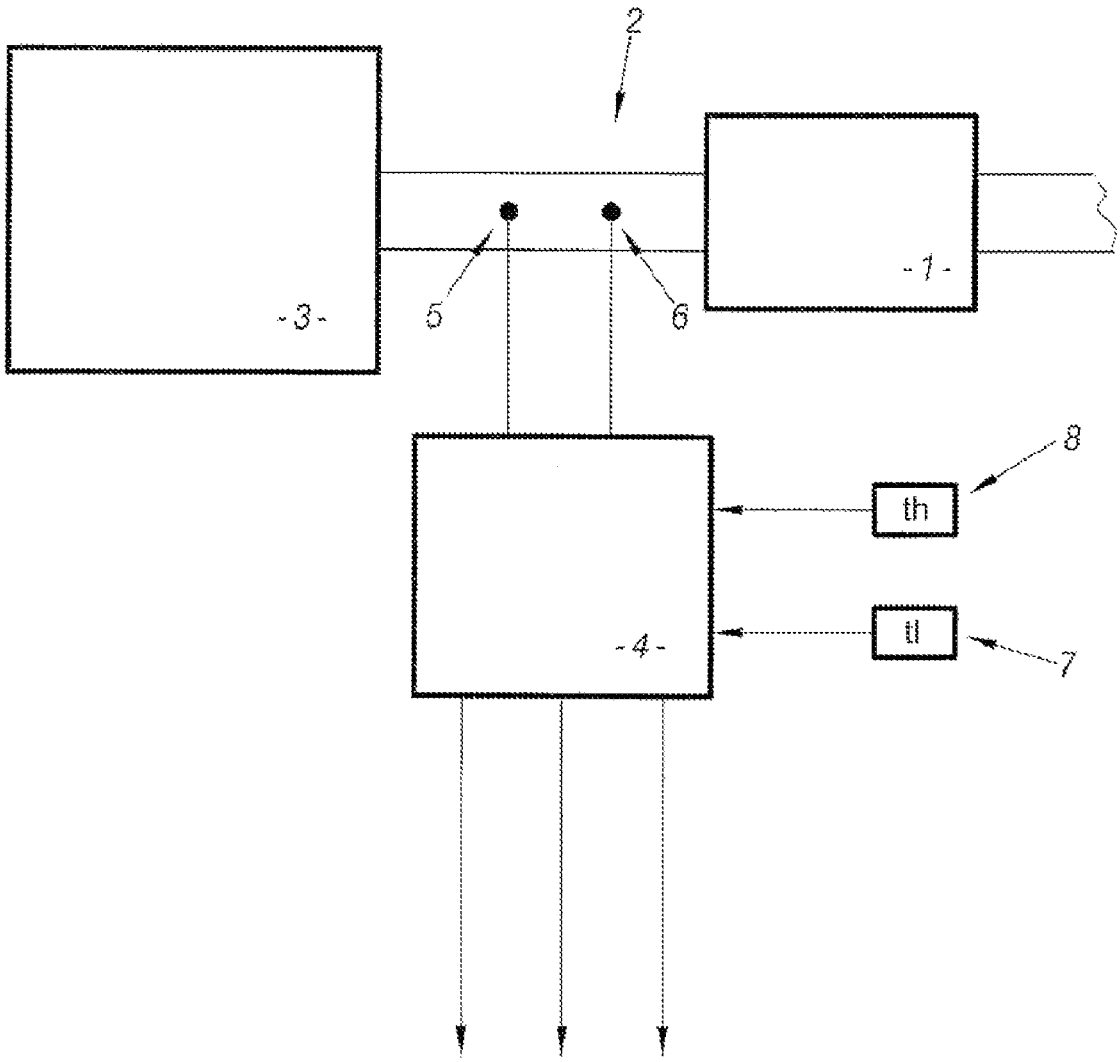

| | | | | |
|---|---|---|---|---|
| 6,363,713 | B1 * | 4/2002 | Wu et al. | 60/274 |
| 6,401,453 | B1 * | 6/2002 | Lemire | 60/277 |
| 6,408,616 | B1 * | 6/2002 | Mazur et al. | 60/277 |
| 6,453,666 | B1 * | 9/2002 | Surnilla et al. | 60/285 |
| 2003/0089102 | A1 | 5/2003 | Colignon et al. | |
| 2003/0230076 | A1 * | 12/2003 | Kwon | 60/295 |
| 2004/0055280 | A1 * | 3/2004 | Nishizawa et al. | 60/277 |

FOREIGN PATENT DOCUMENTS

| | | | |
|---|---|---|---|
| DE | 10307457 | A1 * | 9/2004 |
| EP | 1310656 | A | 5/2003 |
| FR | 2774421 | A | 8/1999 |
| FR | 2829798 | A | 3/2003 |

OTHER PUBLICATIONS

International Search Report mailed Mar. 1, 2006 in PCT/FR/2005/050465.

* cited by examiner

SYSTEM FOR EVALUATING REGENERATION OF POLLUTION MANAGEMENT MEANS INTEGRATED IN A MOTOR VEHICLE ENGINE EXHAUST LINE

The present invention concerns a system for evaluating a regeneration of depollution means integrated in an exhaust line of a motor vehicle engine, and in particular the effectiveness thereof.

Indeed, some system for controlling the operation of an engine require, for their operation, information relative to the performance of a regeneration phase of this type of depollution means, such as a particle filter.

Indeed, these systems are designed to take into account such information in order to modify, for example, the conditions in which the next attempts at regenerating the filter will be performed.

The systems used until now to obtain this type of information are either relatively complex or hardly reliable.

The objective of the invention is thus to remedy these problems by proposing such a system.

To this effect, an object of the invention is a system for evaluating a regeneration of depollution means integrated in an exhaust line of a motor vehicle engine, characterized in that it comprises means for determining the thermal power provided by the exhaust gases upstream of the depollution means during the regeneration phase thereof, and means for comparing this power to threshold values to determine a failed, partial, or total regeneration of these means.

According to other characteristics:

the means for determining the thermal power are associated with means for determining the flow rate of the gases in the exhaust line and of the temperature thereof upstream of the depollution means and comprise:

means for calculating the thermal capacity of the exhaust gases, $c_p$, according to the equation:

$$c_p = 1.07^* \frac{|39.06 - 512.79^*_T{}^{-1.5} + 1072.7^*_T{}^{-2} - 820.4^*_T{}^{-3}|}{28.013}$$

in which T represents the temperature of the gases upstream of the depollution means, and means for calculating the thermal power provided $P_{th}$ according to the equation:

$$P_{th}=\text{Gas flowrate}^*(T\text{ upstream }PF)^*c_p$$

where:

Gas flow rate represents the flow rate of the gases in the exhaust line,

T upstream PF represents the temperature of the exhaust gases upstream of the depollution means, and $c_p$ is the thermal capacity of the gases calculated previously;

the determination means comprise means for performing the average of the values of the thermal powers calculated at each time step during regeneration, the comparison means are adapted to compare the average thermal power to a predetermined low threshold value and to a predetermined high threshold value to evaluate a failed regeneration if the average thermal power is lower than the low threshold value, a total regeneration is the thermal power is higher than the high threshold value, and a partial regeneration in the other situations, the thermal power provided is calculated between the start of a request for regeneration assistance plus a predetermined time period and the stopping of this request for assistance plus the predetermined time period, and the time period is capable of being calibrated.

Figure 2:
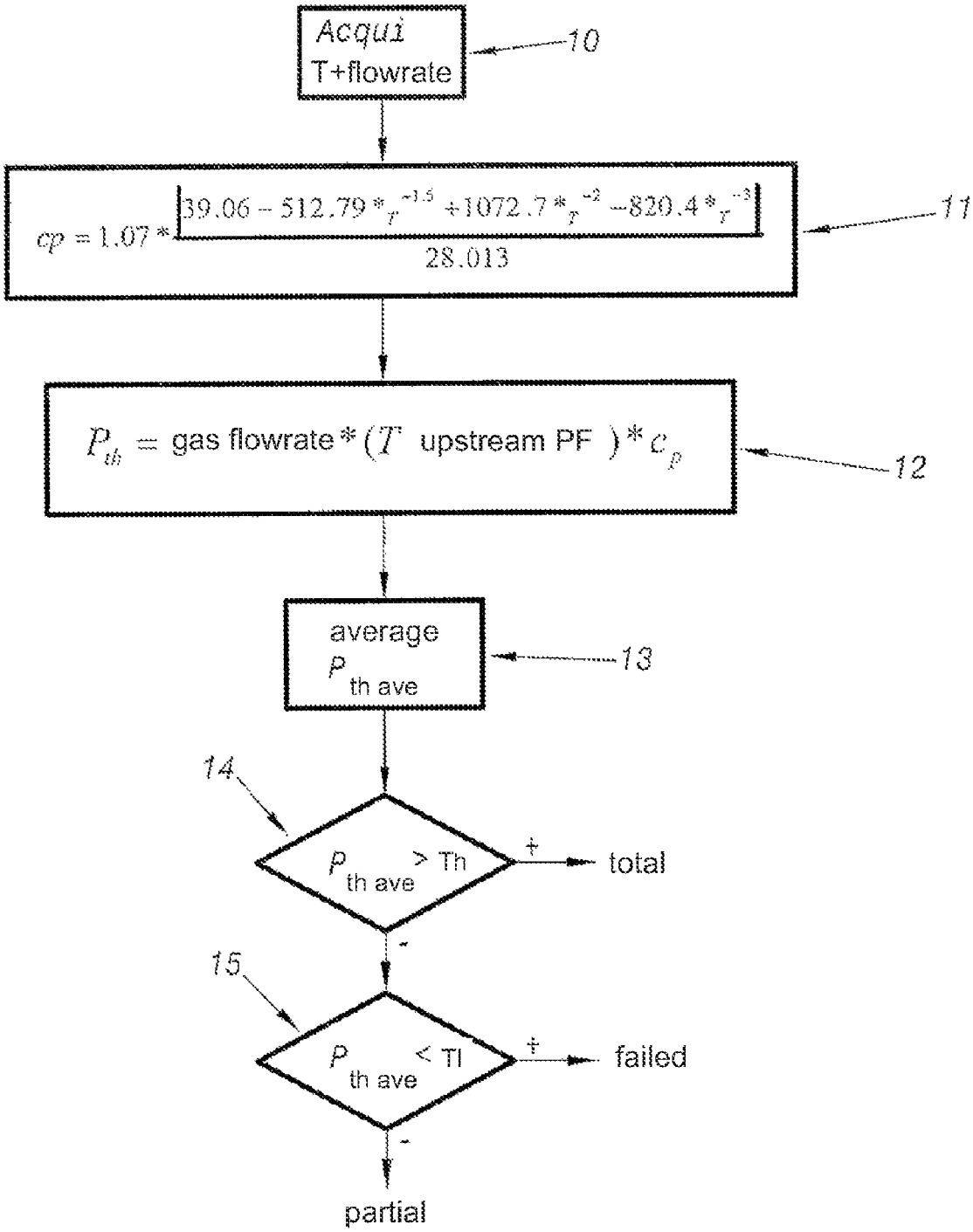

The invention will be better understood by reading the following description given by way of example only and made in reference to the annexed drawings in which:

FIG. 1 is a synoptic schematic view illustrating the general structure of an evaluation system according to the invention associated with a motor vehicle engine, and FIG. 2 is a flow chart illustrating the operation of this system.

Indeed, FIG. 1 shows a system for evaluating a regeneration of depollution means such as a particle filter designated by the general reference 1 on this Figure, integrated in the exhaust line 2 of a motor vehicle engine 3.

Of course, various embodiments of these depollution means can be envisioned as is well known in the state of the art (particle filter, catalyzed particle filter, NOx trap, particle filter impregnated with a NOx trap function, oxidation or SCR catalyst, etc.).

According to the invention, this system comprises means for determining the thermal power provided by the exhaust gases upstream of the particle filter 1 during the regeneration phase thereof, and means for comparing this power to threshold values to determine a failed, partial, or total regeneration of the particle filter.

These means comprise, for example, an appropriate computer designated by the general reference 4, and connected to means for determining the flow rate of the gases in the exhaust line designated by the general reference 5 on this Figure and formed by any appropriate means, and to means for determining the temperature of these gases upstream of the particle filter, these means being designated by the general reference 6 on this Figure and also comprising any appropriate means.

This computer receives also as input predetermined low threshold values and predetermined high threshold values, noted Tl and Th, respectively, on this FIG. 1, from means for establishing these values designated by the references 7 and 8.

These means have also any appropriate structure.

The operation of this system is illustrated on FIG. 2.

This operation begins by a step 10 of acquisition of the information on the flow rate of the gases in the exhaust line and of the temperature thereof upstream of the particle filter.

Then, at a step 11, the computer 4 is adapted to calculate the thermal capacity of the exhaust gases, cp, according to the equation:

$$c_p = 1.07^* \frac{|39.06 - 512.79^*_T{}^{-1.5} + 1072.7^*_T{}^{-2} - 820.4^*_T{}^{-3}|}{28.013}$$

in which T represents the temperature of the gases upstream of the depollution means, During a step 12, the computer is adapted to calculate the thermal power provided $P_{th}$ according to the equation:

$$P_{th}=\text{Gas flowrate}^*(T\text{ upstream }PF)^*c_p$$

where:

gas flow rate represents the flow rate of the gases in the exhaust line,

T upstream PF represents the temperature of the exhaust gases upstream of the depollution means, and $c_p$ is the thermal capacity of the gases calculated previously.

The computer is then adapted to perform, during step 13, the average of the thermal power values calculated at each time step during the regeneration of the particle filter, in order to provide an average thermal power noted $P_{th\ ave}$.

Finally, during the steps 14 and 15, respectively, this average thermal power is compared to the high and low threshold values, respectively, to make it possible for the computer, if this average thermal power is higher than the high threshold value, to provide an information of total regeneration of the particle filter, if the average thermal power is lower than the low threshold value, to provide an information of failed regeneration of the particle filter, and in the other situations, to provide an information of partial regeneration of this particle filter.

It will also be noted that the thermal power provided can be calculated between the start of a request for regeneration assistance plus a predetermined time period and the stopping of this request for assistance plus the predetermined time period, this time period being, for example, capable of being calibrated, in order to take into account the response time of the means for acquiring information as well as the thermal inertia of the exhaust line.

It will also be noted that the average value $P_{th\ ave}$ is in fact an image of the effectiveness, for example, of the post-injections used to assist in the regeneration of the particle filter, in terms of the thermal level generated during the request for assistance.

Of course, other embodiments can be envisioned, as well as other balances of the regeneration/estimation of the effectiveness of the regeneration of the depollution means.

The invention claimed is:

1. System for evaluating a regeneration of particle filter integrated in an exhaust line of a motor vehicle engine, which comprises:

means for determining the thermal power provided by the exhaust gases upstream of the particle filter during the regeneration phase thereof, and means for comparing this power with threshold values and for determining (i) a failed regeneration, (ii) a partial regeneration, or (iii) a total regeneration of the particle filter as a function of this comparison wherein the means for determining the thermal power are associated with means for determining the flow rate of the gases in the exhaust line and of the temperature thereof upstream of the particle filter and comprise: means for calculating the thermal capacity of the exhaust gases, Cp, according to the equation:

$$c_p = 1.07 * \frac{|39.06 - 512.79 * T^{-1.5} + 1072.7 * T^{-2} - 820.4 * T^{-3}|}{28.013}$$

in which T represents the temperature of the gases upstream of the particle filter, and means for calculating the thermal power provided $P_{th}$ according to the equation:

$$P_{th} = \text{Gas flowrate} * (T\ \text{upstream}\ PF) * Cp$$

where Gas flowrate represents the flow rate of the gases in the exhaust line, (T upstream PF) represents the temperature of the exhaust gases upstream of the particle filter, and Cp is the thermal capacity of the gases calculated previously, and wherein the determination means comprise means for performing the average of the values of the thermal powers calculated at each time step during regeneration.

2. System according to claim 1, wherein the comparison means are adapted to compare the average thermal power ($P_{th\ ave}$) to a predetermined low threshold value and to a predetermined high threshold value to evaluate a failed regeneration if the average thermal power is lower than a low threshold value, a total regeneration if the thermal power is higher than the high threshold value, and a partial regeneration in the other situations.

3. System according to claim 1, wherein the thermal power provided is calculated between the start of a request for regeneration assistance plus a predetermined time period and the stopping of this request for assistance plus the predetermined time period.

4. System according to claim 3, wherein the time period is capable of being calibrated.

5. Method of evaluating a regeneration of a particle filter integrated in an exhaust line of a motor vehicle engine, comprising:

determining the thermal power provided by the exhaust gases upstream of the particle filter during the regeneration phase thereof, and comparing this power with threshold values, and determining (i) a failed regeneration, (ii) a partial regeneration, or (iii) a total regeneration of the particle filter as a function of this comparison wherein the determination of the thermal power comprises: determining the flow rate of the gases in the exhaust line and of the temperature thereof upstream of the particle filter, calculating the thermal capacity of the exhaust gases, Cp, according to the equation:

$$c_p = 1.07 * \frac{|39.06 - 512.79 * T^{-1.5} + 1072.7 * T^{-2} - 820.4 * T^{-3}|}{28.013}$$

in which T represents the temperature of the gases upstream of the particle filter, and calculating the thermal power provided Pth according to the equation:

$$P_{th} = \text{Gas flowrate} * (T\ \text{upstream}\ PF) * Cp$$

where Gas flowrate represents the flow rate of the gases in the exhaust line, (T upstream PF) represents the temperature of the exhaust gases upstream of the particle filter, and Cp is the thermal capacity of the gases calculated previously, and wherein the determination of the thermal power comprises performing the average of the values of the thermal powers calculated at each time step during regeneration.

6. Method according to claim 5, wherein the comparison comprises comparing the average thermal power ($P_{th\ ave}$) to a predetermined low threshold value and to a predetermined high threshold value to evaluate a failed regeneration if the average thermal power is lower than a low threshold value, a total regeneration if the thermal power is higher than the high threshold value, and a partial regeneration in the other situations.

7. Method according to claim 5, wherein the thermal power provided is calculated between the start of a request for regeneration assistance plus a predetermined time period and the stopping of this request for assistance plus the predetermined time period.

8. Method according to claim 7, wherein the time period is capable of being calibrated.

* * * * *